United States Patent [19]

Doom

[11] 4,136,972

[45] Jan. 30, 1979

[54] PREMIXER

[76] Inventor: Lewis G. Doom, 95 Meadow Farm Rd., East Islip, N.Y. 11730

[21] Appl. No.: 731,776

[22] Filed: Oct. 12, 1976

Related U.S. Application Data

[63] Continuation of Ser. No. 590,578, Jun. 26, 1975, abandoned.

[51] Int. Cl.[2] ..... B01F 7/20; B01F 7/22

[52] U.S. Cl. ..... 366/262; 366/314

[58] Field of Search ..... 259/7, 8, 23, 24, 43, 259/44, 107, 108, 121, 122, DIG. 30, 9, 10, 191, 192, 109, 110, 25, 26

[56] References Cited

U.S. PATENT DOCUMENTS

| | | | |
|---|---|---|---|
| 700,033 | 5/1902 | Glatz | 259/23 |
| 2,920,964 | 1/1960 | Oakes | 426/26 |
| 3,365,176 | 1/1968 | Christensen | 259/107 |
| 3,415,494 | 12/1968 | Fisher | 259/8 |
| 3,456,599 | 7/1969 | Baker | 259/9 |
| 3,652,062 | 3/1972 | Baker | 259/9 |
| 3,709,664 | 1/1973 | Krekeler | 259/7 |

*Primary Examiner*—Robert W. Jenkins

*Attorney, Agent, or Firm*—Hopgood, Calimafde, Kalil, Blaustein and Lieberman

[57] ABSTRACT

Premixing apparatus includes a number of elongated interdigitated rotors and stators. At least some of the rotors and/or stators include a first longitudinal portion with a transverse axis oriented at a first angle with respect to the horizontal axis and a second longitudinal portion with a transverse axis which forms an acute angle with the transverse axis of the first portion.

10 Claims, 4 Drawing Figures

PREMIXER

This is a continuation of application Ser. No. 590,578, filed June 26, 1975, now abandoned.

BACKGROUND

In products comprising a number of individual ingredients it is frequently desirable to premix these ingredients sufficiently to provide a uniform slurry which is suitable either for immediate use or for further processing in other mixing apparatus. Premixing apparatus for this purpose may include a cylindrical housing with a centrally disposed rotatable shaft. A number of rotor blades are mounted on the central shaft so that they extend outwardly toward the surrounding housing and a number of cooperating stator blades are mounted about the outer wall of the cylindrical housing so that they extend inwardly toward the shaft interdigitating with the rotors. In operation the central shaft rotates causing the attached rotor blades to pass between the stator blades thereby mixing and beating a mixture of ingredients introduced into the housing causing these ingredients to form a uniform slurry.

In prior art devices of this type the individual rotor and stator blades consisted of elongated substantially bar-like members oriented at a uniform angle to the horizontal plane such that when the shaft rotated the rotors impelled the ingredients to be mixed downwardly within the cylindrical housing. In such an apparatus centrifugal force causes a vortex to form about the central shaft and the ingredients tends to ride up along the outer wall of the housing where they are incompletely mixed. If such apparatus is filled to capacity, material can spill out of the housing during operation. With such prior art premixers ingredients introduced into the top of the housing often failed to mix adequately within an acceptable period of mixing time because of the lack of circulation of the ingredients within the housing.

In commercially useable premixing apparatus of the type described above, it is important to provide thorough mixing of a maximum quantity of ingredients in a minimum time without the incorporation of air into the mixture. Air should be excluded during this premixing step so that controlled amounts of air may be introduced into the mixture in later processing steps.

With prior art apparatus the user has to choose between two equally unsatisfactory alternatives. He could achieve adequate mixing in a relatively short time if the cylindrical housing was filled to only approximately 80% of its capacity or he could fill the housing to its capacity which would require mixing times up to five times as long. Since such long mixing times were unacceptable most users chose to utilize only 80% of the rated capacity of their equipment. Because of the large vortex about the central shaft and the tendency for material to climb up along the outer housing wall, such prior art apparatus also tended to introduce varying amounts of air into the slurry.

The above deficiencies of the prior art apparatus are overcome in the present apparatus by utilizing an improved configuration for the rotor and/or stator blades of the premixer. The use of rotor and/or stator blades of the inventive configuration results in better overall circulation of the ingredients introduced into the cylindrical housing and provides more thorough mixing of a larger quantity of material within a far shorter time then prior art devices as described above while avoiding the introduction of air into the premixed slurry.

SUMMARY OF THE INVENTION

Mixing apparatus includes a housing having a central axis; a rotatable shaft disposed along said central axis; and a first and second group of interdigitated members each of which having a longitudinal axis, and first and second ends. Each of the first group of members is attached at the first end to the rotatable shaft and extends outwardly from the rotatable shaft toward the housing and each of the second group of members is attached at the first end to the housing and extends inwardly from the housing toward the shaft. At least some of said members of at least one of said groups of members includes shaped members having a first and second longitudinal portions adjacent respectively to the first and second ends, in which the first portion has a first lateral axis passing through the longitudinal axis and a second portion having a second lateral axis passing through the longitudinal axis, and in which the first and second lateral axes define an acute angle.

DESCRIPTION OF THE INVENTION

Figure 1:
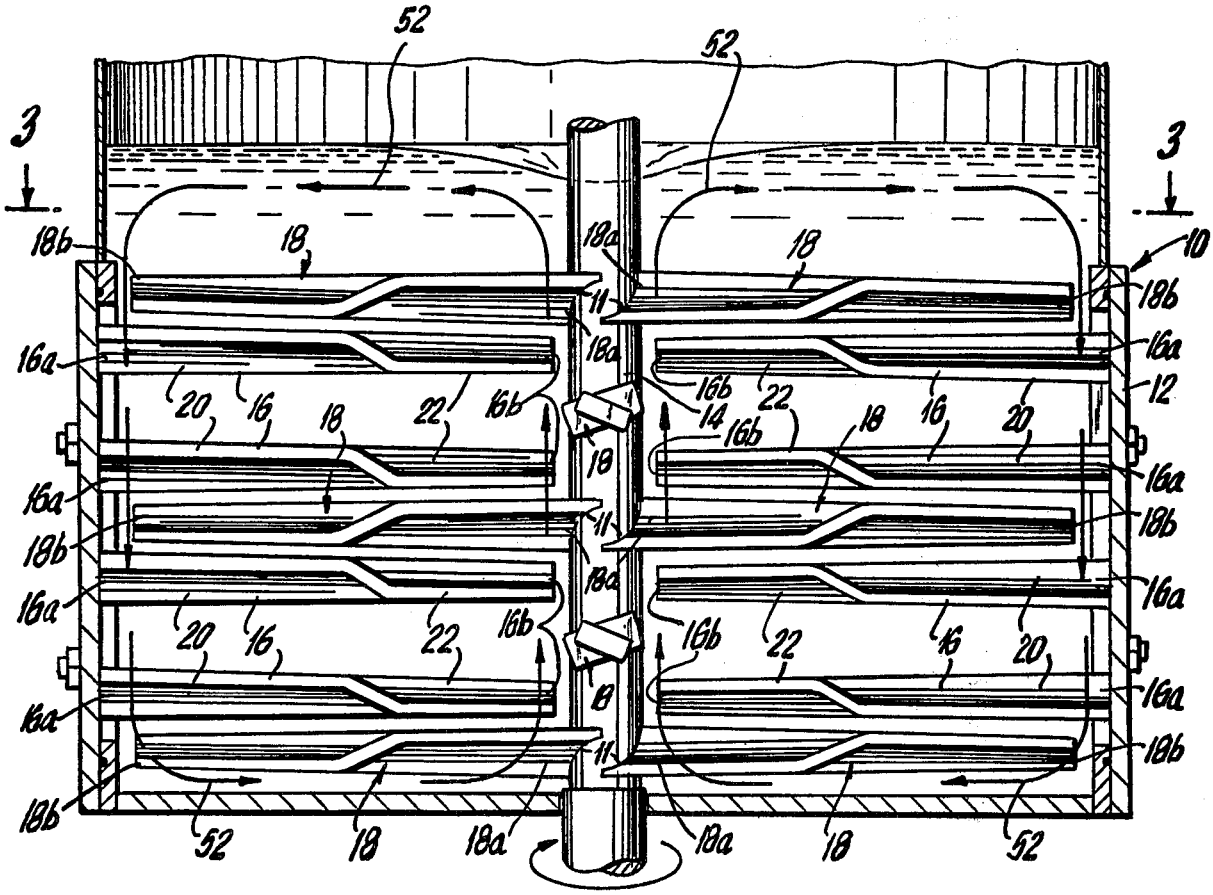
FIG. 1 is a partially sectional side elevational view of the premixer of this invention.

FIG. 1 shows a pre-mixing apparatus utilizing the improved rotor and stator blades of the present invention. The apparatus 10 includes a substantially cylindrical housing 12 and a centrally mounted rotatable shaft 14. Means, such as a motor and associated drive train, which are not shown but are well known in the art may be provided to turn the rotatable shaft 14. A number of stator blades 16 are attached to cylindrical housing 12 at a first end **16*a* by welding or other suitable means and extend inwardly in a substantially horizontal plane in the direction of shaft 14. The inner ends 16*b* of the stators 16 are positioned a short distance from the rotatable shaft 14. A number of rotors 18 are attached at a first end 18*a* to the rotating shaft 14. An aperture 11 having the same inside diameter as the outside diameter of shaft 14 may be formed in the end 18*a* of each rotor 18 and the wall of the aperture 11 may be attached to shaft 14 by welding or other suitable means. The rotors 18 extend outwardly from the shaft 14 in a substantially horizontal plane in the direction of the housing 12. The outer ends 18*b* of rotors 18 are spaced a short distance from the housing 12** to permit rotation.

Figure 2:
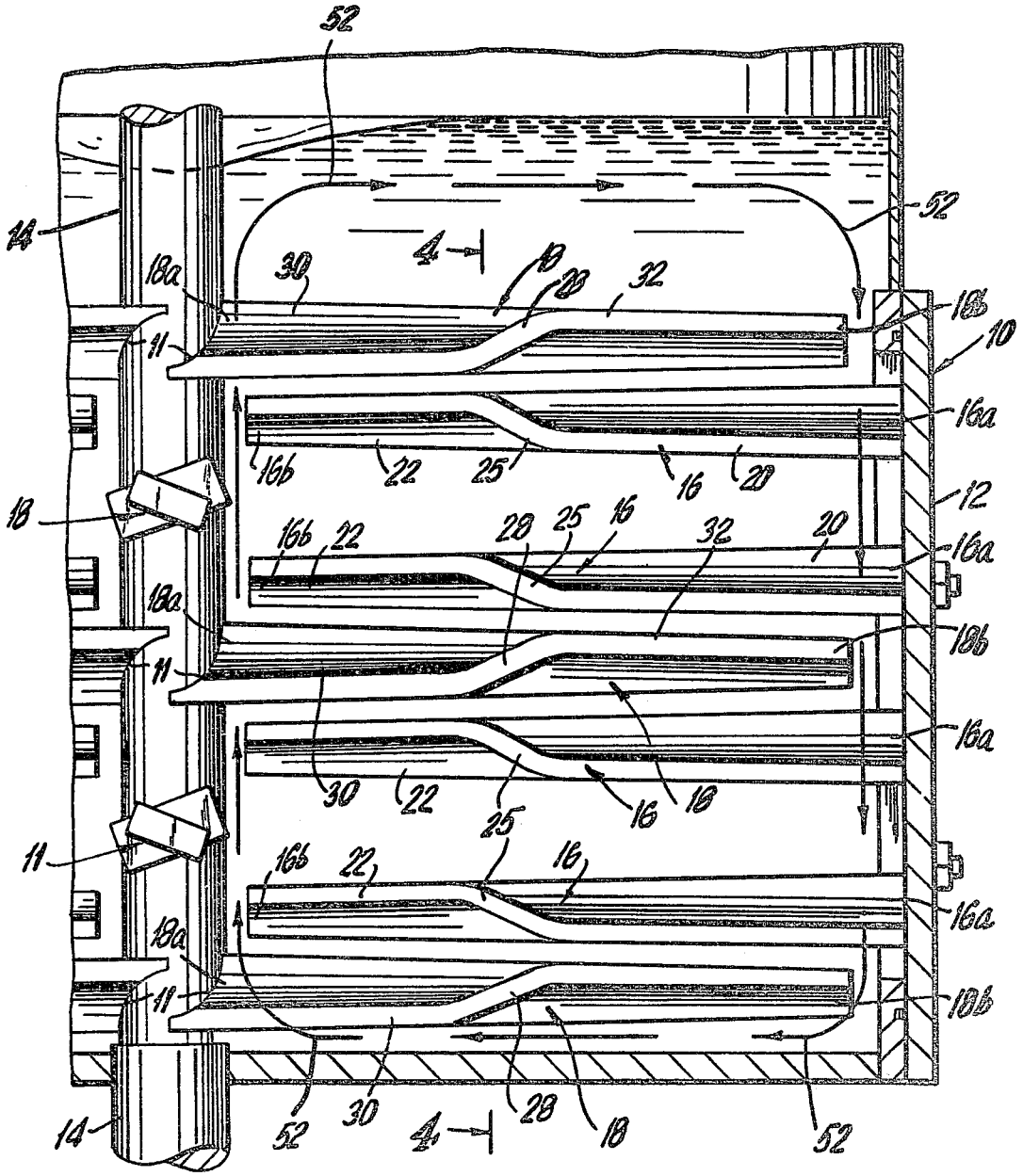
FIG. 2 is an enlarged side elevation of a portion of FIG. 1.
Figure 3:
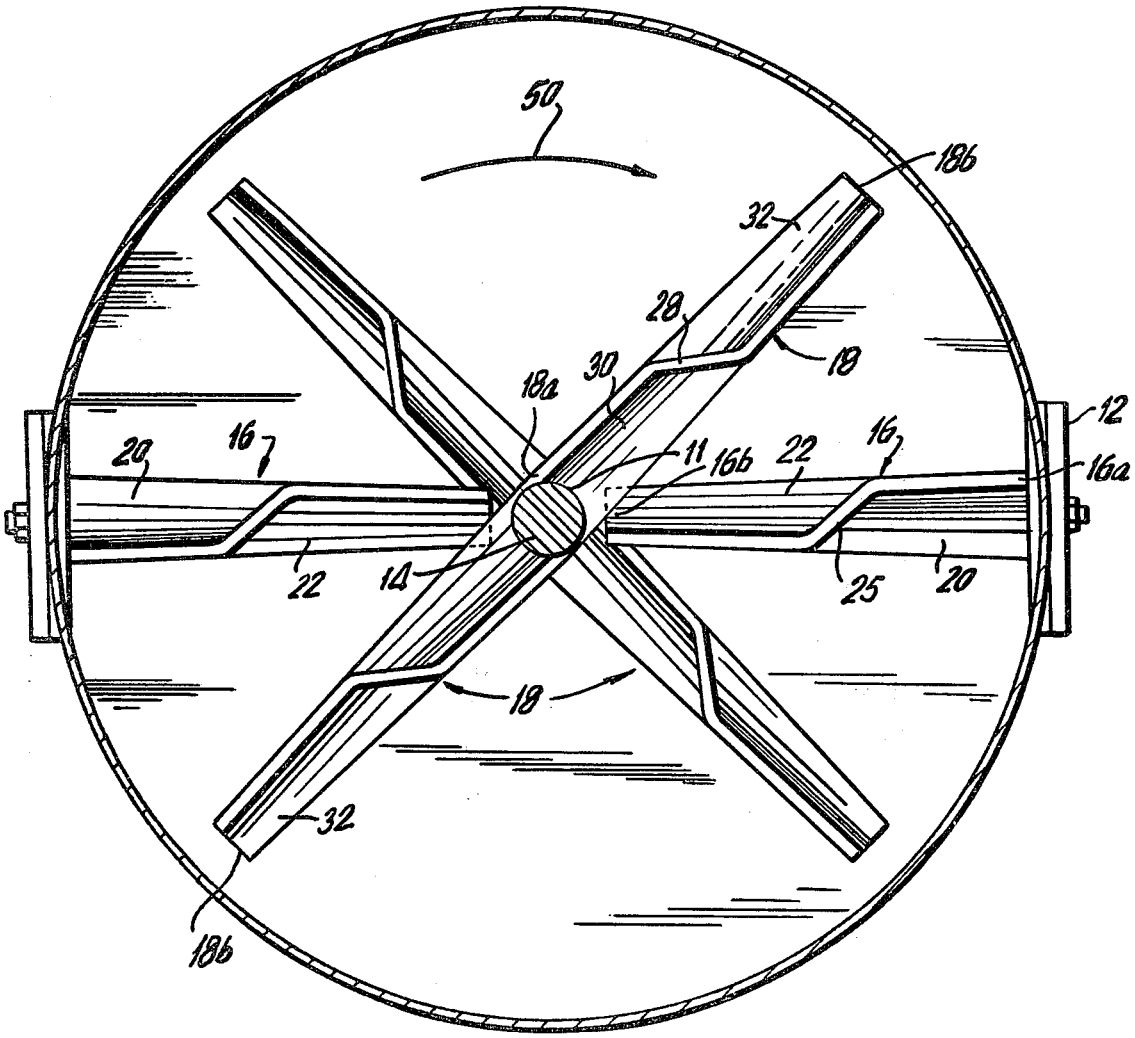
FIG. 3 is a cross sectional view taken along plane 3—3 of FIG. 1.
Figure 4:
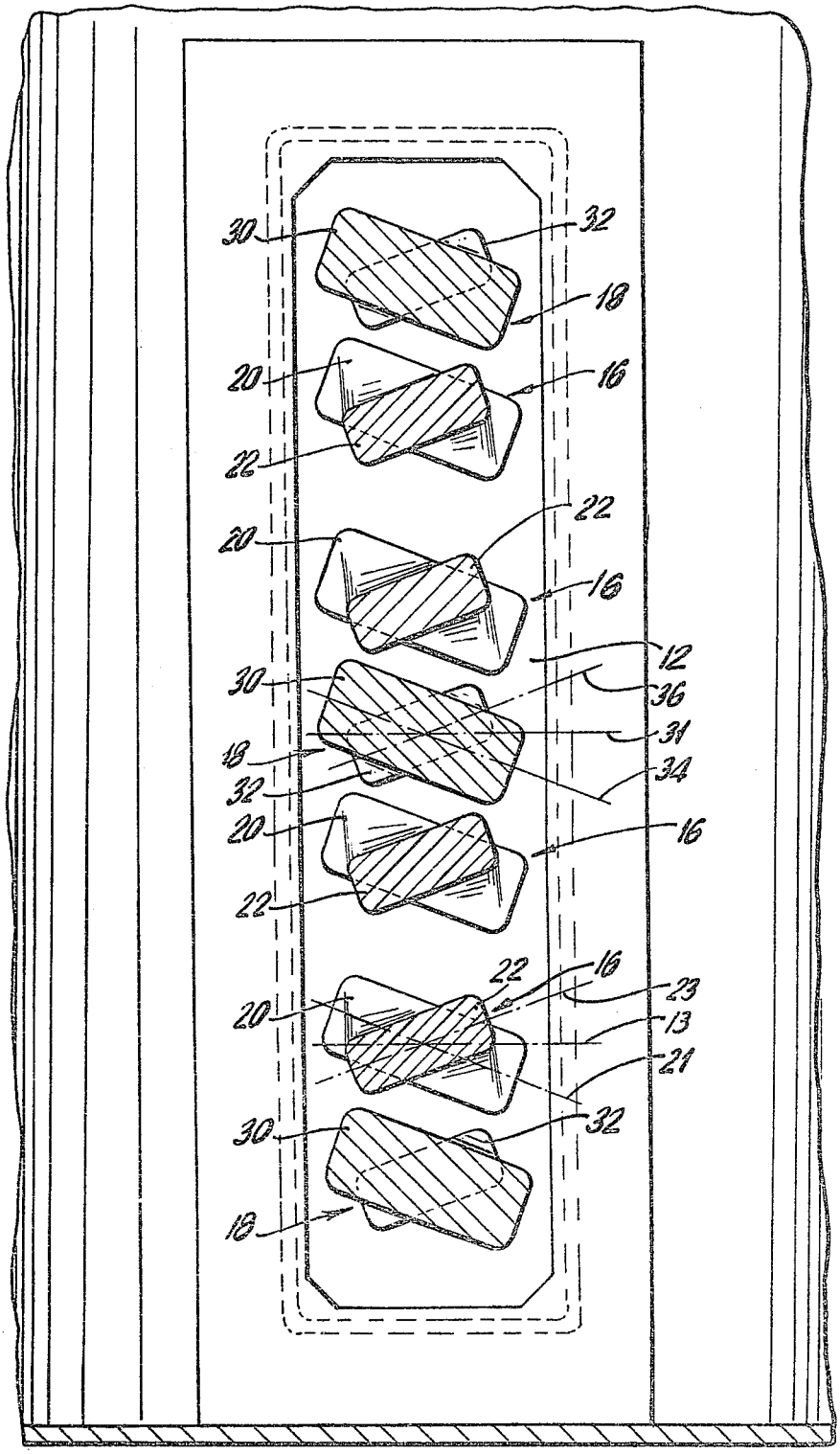
FIG. 4 is a cross sectional view taken along plane 4—4 of FIG. 2.

As can best be seen in FIGS. 2, 3 and 4 each of the stator blades 16 includes a first longitudinal portion 20 which is adjacent to housing 12 and a second longitudinal portion 22 which is spaced from the housing 12. As best seen in FIG. 4 the lateral axis 21 of the first longitudinal portion 20 is oriented at an angle with respect to a horizontal plane 13 passing through the stator 16. The lateral axis 23 of the second portion 22 of stator 16 is oriented at an approximately equal and opposite angle with respect to the horizontal plane 13. Within a central portion 25, the stator blade 16 changes from the first to the second orientation with respect to the horizontal plane 13.

A stator blade 16 as described above may be formed by bending a single member of substantially rectangular cross section about its longitudinal axis until the desired orientation of portions 20 and 22 is achieved, by casting the member in this shape or by fixedly attaching two separate parts constituting respectively portions 20 and 22, for example, by welding these portions together within the central portion 25 to form a unitary member. In either case the lateral axes 21 and 23 of portions 20 and 22 of the completed stator 16 form an acute angle which is preferably bisected by the horizontal plane 13. It has been found that an angle of approximately 40° between the lateral axes 21 and 23 which is bisected by the horizontal axis 13 so that axes 21 and 23 are each oriented at an angle of 20° with respect to the horizontal axis provides a stator of superior mixing characteristics.

As can best be seen in FIGS. 3 and 4 individual stator blades 16 may be tapered from a maximum width at the first end **16*a* which is attached to the housing wall 12 to a minimum width at the second end 16*b* which is adjacent to the rotating shaft 14. This taper provides a maximum width at the point of attachment to the housing 12 and provides a lesser width at the end 16*b* spaced from the housing. This taper results in a decrease in the vertical spacing between the rotors and stators, thus allowing more mixing elements in a given height of unit. This increases the mixing capacity of the unit and at the same time gives maximum strength to the blades. It has been found that an angle of taper of approximately 2° along each of the longitudinal sides of the stator 16** provides a superior stator from the point of view of both strength and element spacing.

FIGS. 2, 3 and 4 also show the rotor members 18 in detail. The rotor blades 18 include a first end **18*a* having a groove 11 formed therein. The groove 11 has substantially the same inside diameter as the outside diameter of cylindrical shaft 14 so that rotor member 18 may be fixedly attached to shaft 14 by welding or other suitable means along groove 11. Rotors 18 extend outwardly from the shaft 14 in a substantially horizontal plane such as 31 in FIG. 4 terminating in end 18*b* which is adjacent to, but spaced from, the housing 12 to permit rotation of the rotors 18 when shaft 14** is rotated.

The rotors 18 include a first longitudinal portion 30 which is adjacent to end **18*a* and a second longitudinal portion 32 adjacent to end 18*b* and located at the outer end of the rotor. As in the case of stator 16 the first portion 30 is slanted so that its lateral axis 34 forms an angle with the horizontal plane 31. The second portion 32 is slanted in a direction opposite to portion 30 with respect to the horizontal plane 31 so that its lateral axis 36 forms an angle which is opposed to and preferably substantially equal to the angle formed by the lateral axis 34 of the first portion 30. It has been found that providing an angle of approximately 40° between the lateral axes 34 and 36 which is approximately bisected by the horizontal plane 31** results in a rotor of superior mixing qualities.

As in the case of stator 16, the rotor 18 further includes a central portion 28 in which the rotor lateral axis changes from the orientation in the first portion 30 to that in the second portion 32. As in the case of stators 16, rotors 18 may be formed from a single bar member by bending the member to provide the desired configuration by casting a member in that configuration or by fixedly joining two separate members comprising respectively portions 30 and 32 in a manner known in the art, such as welding, within portion 28 to form a unitary member.

As can best be seen in FIGS. 3 and 4 the rotors 18 are tapered from a maximum width at end **18*a* where they are attached to shaft 14 to a minimum width at their outer end 18*b*. As in the case of stators 16 this results in a rotor of superior strength while permitting a maximum number of rotors and stators to be mounted within the available space in the premixer apparatus. As in the case of stators 16, the rotors 18 are tapered at an angle of approximately 2° along each longitudinal side of the rotor to provide a superior rotor configuration having maximum width and therefore strength at their point of attachment to shaft 14**. Tapering both the rotors and stators permits the inclusion of an extra set of blades and can provide up to 25% better mixing.

As can best be seen in FIG. 2, the rotors 18 interdigitate with the stators 16 as they are rotated by shaft 14 so that the smaller second portion 32 of the rotor passes over the larger first portion 20 of the stator. Portion 32 of each rotor 16 slants downwardly at a first angle approximately equal and opposite to the angle at which the first portion 20 of the stator is oriented upward with respect to the horizontal axes passing through them. The shaft 14 rotates in clockwise direction as shown by arrow 50, FIG. 3, so that the material to be mixed tends to be impelled downwardly by portion 32 of the rotor across the sloping surface of portion 20 of the adjacent stator in areas adjacent to housing 12 giving rise to the downward circulation of material in this area shown by arrows 52.

The first portion 30 of rotor 18 passes over the second portion 22 of the stator. Portion 30 of the rotor, slants upwardly at an approximately equal and opposite angle to the downward slope of stator portion 22 with respect to the horizontal axes passing through them. As the shaft 14 rotates in a clockwise direction as shown by FIG. 3 the material to be mixed is impelled upward along shaft 14 by rotating rotor portion 30 across the under surface of stator portion 22 giving rise to an overall upward movement of material along shaft 14 as shown by arrows 52. The combination of these two motions provides an overall circulation of the material to be mixed as shown by arrows 52 and provides superior mixing capability without the incorporation of air into the slurry.

By creating the circulation shown by arrows 52 the improved rotor and stator configuration offsets the tendency of the material being mixed to climb up the housing wall. The upward force along the shaft 14 also minimizes the tendency of the material to form a vortex along the shaft 14. By preventing material from riding up the housing wall and decreasing the vortex adjacent to the shaft 14 the improved apparatus greatly decreases the amount of undesirable air which is introduced into the ingredients during premixing. By providing a general circulation of material within housing 12 as illustrated by arrows 52 of FIGS. 1 and 2, all ingredients move through the various levels within housing 12 and are thoroughly mixed off-setting the tendency found in prior art apparatus for material to remain at the top of the housing and not be mixed with other ingredients.

Although the above preferred embodiment has been described as utilizing both stators and rotors of applicant's improved configuration, considerable improvement over prior art premixers can be achieved if either the rotors or the stators utilize the improved configuration while the other members are made in the prior art bar-like shape. A greater improvement is realized if the rotors alone are made in the improved configuration rather than the stators alone being made in this configuration but some improvement is realized in either case. If desired only some of the rotors and/or stators can be made in the improved configuration while others are made in accordance with the prior art. This again will result in improvement over prior art apparatus.

In prior art premixers of the same size using conventional rotor and stator blades only 800 pounds of material to be mixed could be loaded into a mixer rated at 1,000 pound capacity if mixing was to be completed within 2½ minutes. If a full 1,000 pounds was placed in the housing 12 of the mixer a substantially longer period was required to achieve adequate mixing in prior art mixers. By contrast, the improved premixer of this invention utilizing applicant's improved rotors and stators provides superior mixing of loads of up to 1,000 pounds, or full rated capacity, in under 2 minutes with no substantial incorporation of air in the mixture. The improved circulation provided by the configuration and arrangement of rotor and stator blades in this premixer also prevents dry materials from remaining at the top of the mixing container and cause them to mix in with the remainder of the mixture.

Although the present invention has been described in conjunction with preferred embodiments, it is to be understood that modifications and variations may be resorted to without departing from the spirit and scope of the invention as those skilled in the art will readily understand. Such modifications and variations are considered to be within the purview and scope of the invention and appended claims.

I claim:

1. Mixing apparatus including a housing having a central axis;

a rotatable shaft disposed along said central axis and adopted to rotate in a predetermined direction; and a first and second group of interdigitated members each member having a leading and a trailing edge when said shaft rotates in said predetermined direction, a longitudinal axis and first and second ends, each of said first group of members being attached at said first end to said rotatable shaft and extending outwardly from said rotatable shaft toward said housing and each of said second group of members being attached at said first end to said housing and extending inwardly from said housing toward said shaft, and all of said members of both said first and said second groups of members comprising shaped members, each of said shaped members including first and second longitudinal portions adjacent respectively to said first and second ends, said first portion having a first lateral axis passing through said longitudinal axis, said first lateral axis sloping downwardly from said leading to said trailing edge, and a second portion having a second lateral axis passing through said longitudinal axis, said second lateral axis sloping downwardly from said leading to said trailing edge, said first and second lateral axes forming an acute angle.

2. Mixing apparatus as claimed in claim 1 in which said longitudinal axes of said members are in planes substantially perpendicular to said central axis and in which said planes bisect the angle defined by said first and second lateral axes of said shaped members.

3. Mixing apparatus as claimed in claim 2 in which the angle between said plane and each of said first and second lateral axes of said shaped members is approximately 20°.

4. Mixing apparatus as claimed in claim 1 in which the acute angle formed by said first and said second lateral axes of said shaped members is approximately 40°.

5. Mixing apparatus as claimed in claim 1 in which at least some of said members in at least one of said first and second groups of members are tapered from a maximum width at said first end to a minimum width at said second end.

6. Mixing apparatus as claimed in claim 5 in which the angle of said taper is approximately 2° along each lateral side of said member.

7. Mixing apparatus including:

a housing having a central axis;

a rotatable shaft disposed along said central axis and adopted to rotate in a predetermined circumferential direction; and a plurality of stator members having first and second ends, and leading and trailing edges with respect to said predetermined circumferential direction each of said stator members being attached at said first end to said housing and extending inwardly in a substantially horizontal plane so that said second end is positioned adjacent to said rotatable shaft, each of said stators having a first portion adjacent to said first end, said first portion having a first transverse axis which slopes upwardly from said leading to said trailing edge to form a first acute angle with said horizontal plane and a second portion adjacent to said second end, said second portion having a second transverse axis which slopes downwardly from said leading to said trailing edge to form a second angle with said horizontal plane which second angle is substantially equal and opposite to said first angle; and a plurality of rotor members having a first and second end and leading and trailing edges when said shaft rotates in said predetermined circumferential direction interdigitated with said stator members, each of said rotor members being attached at said first end to said rotatable shaft and extending outwardly from said shaft in a substantially horizontal plane so that said second end is positioned adjacent to said housing, each of said rotor members having a first portion adjacent to said first end, said first portion having a first transverse axis which slopes upwardly from said leading to said trailing edge to form a third acute angle with said horizontal plane and a second portion adjacent to said second end, said second portion having a transverse axis which slopes downwardly from said leading to said trailing edge to form a fourth acute angle with said horizontal plane, said third and fourth angles being substantially mutually equal and opposite.

8. Mixing apparatus as claimed in claim 7 in which said third angle is substantially equal and opposite to said second angle and said first angle is substantially equal and opposite to said fourth angle.

9. Mixing apparatus as claimed in claim 7 in which at least some of said rotor members are tapered from a maximum lateral width at said first end to a minimum lateral width at said second end.

10. Mixing apparatus as claimed in claim 7 in which at least some of said stator members are tapered from a maximum lateral width at said first end to a minimum lateral width at said second end.

* * * * *